US005624359A

United States Patent [19]

Dean

[11] Patent Number: 5,624,359

[45] Date of Patent: Apr. 29, 1997

[54] APPARATUS FOR STRETCHING MUSCLES AND USE THEREOF

[76] Inventor: Lewis Dean, RR #1, Box 2485, Manchester Center, Vt. 05255

[21] Appl. No.: 364,504

[22] Filed: Dec. 27, 1994

Related U.S. Application Data

[63] Continuation of Ser. No. 198,550, Feb. 18, 1994, abandoned, which is a continuation of Ser. No. 842,458, Feb. 27, 1992, abandoned.

[51] Int. Cl.[6] ..... A63B 21/00

[52] U.S. Cl. ..... 482/91; 482/131

[58] Field of Search ..... 482/91, 95, 49, 482/23, 124, 148, 122, 126, 131

[56] References Cited

FOREIGN PATENT DOCUMENTS

| | | | |
|---|---|---|---|
| 710686 | 6/1965 | Canada | 482/91 |
| 712937 | 7/1965 | Canada | 482/126 |
| 4022347 | 9/1991 | Germany | 482/91 |
| 442378 | 2/1936 | United Kingdom | 482/122 |
| 8403446 | 9/1984 | WIPO | 482/148 |

OTHER PUBLICATIONS

W.L. Cornelius, National Strength and Conditioning Association Journal 13(1):59–61 (1991).

"Synometrics" by Speed Shaper Inc.; Washington Post, Jul. 3, 1983; Copy in 482–91.

*Primary Examiner*—Jerome Donnelly

*Attorney, Agent, or Firm*—Heslin & Rothenberg, P.C.

[57] ABSTRACT

The subject invention provides an apparatus for stretching muscles. The apparatus comprises a plurality of means for engaging a limb connected adjacent to one another. Preferably, the engaging means comprise loops or pockets. The apparatus is used by engaging a portion of a limb with one of the engaging means, and grasping and pulling engaging means on each side of the "engaged" engaging means in a direction opposite or the same as the direction the engaged limb is being moved. In this manner, stretching of muscles in the engaged limb is enhanced.

15 Claims, 2 Drawing Sheets

APPARATUS FOR STRETCHING MUSCLES AND USE THEREOF

This application is a continuation of U.S. application Ser. No. 08/198,550, filed Feb. 18, 1994, now abandoned, which is a continuation of application Ser. No. 07/842,458, filed Feb. 27, 1992, now abandoned.

FIELD OF THE INVENTION

The present invention primarily relates to a device used in exercising, and more particularly to an apparatus for stretching muscles.

BACKGROUND OF THE INVENTION

The stretching out of muscles before exercise is known today to help prevent muscle injury during exercise. To a certain degree a person can stretch his own muscles alone by bending and twisting. However, certain muscles may be more thoroughly stretched with the aid of another person. A second person can apply extra force to the stretching movements to further enhance the effects of stretching. The need for a second person, however, is a disadvantage in that a second person is not always available when a person must stretch. A need thus exists for an apparatus that allows a single person to more thoroughly stretch their muscles, without the need for a second person to assist them.

SUMMARY OF THE INVENTION

This need is met, and the disadvantages of prior stretching methods overcome, by the exercise strap of the subject invention. Accordingly, a principal object of the present invention is to provide an apparatus for stretching muscles.

It is a further object of the invention to provide such an apparatus which can be used by one person without the aid of another person.

The main components of the subject invention include a plurality of means for engaging a limb. These engaging means are connected adjacent to one another and may comprise loops or pockets, for example. The engaging means may be attached to a cord in adjacent fashion. The apparatus for stretching muscles is preferably made of inelastic material such as nylon, or a net-like material.

In its use, one of the engaging means is used to engage a portion of a limb. Engaging means on each side of the "engaged" engaging means are then grasped as the engaged limb is moved in a direction. The grasped engaging means are then pulled in the direction of limb movement, or opposite the direction of limb movement, in order to enhance stretching of muscles in the engaged limb.

BRIEF DESCRIPTION OF THE FIGURES

These and other objects, features and advantages of the subject invention will be evident from the following detailed description of preferred embodiments when read in conjunction with the accompanying drawings in which.

DETAILED DESCRIPTION OF THE INVENTION

Figure 1:
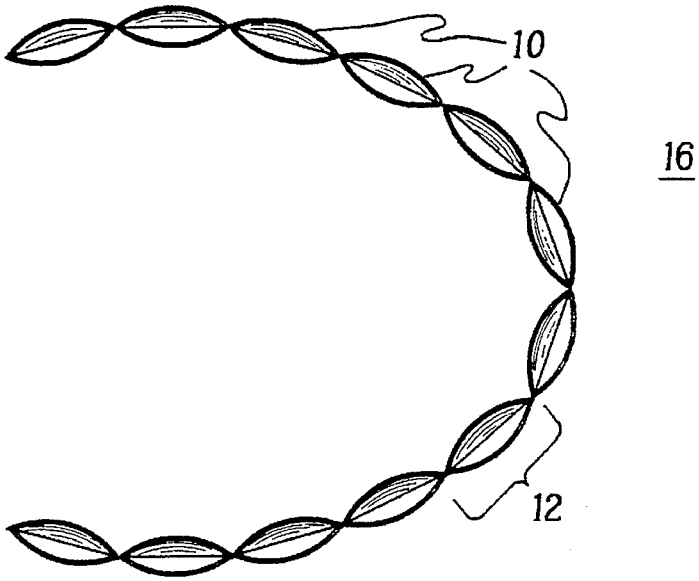
FIG. 1 is a top view of one embodiment of the apparatus of the subject invention wherein the engaging means comprises a pocket.

The main components of one preferred embodiment of the subject invention are depicted in FIG. 1.

FIG. 1 illustrates the apparatus 16 for stretching muscles which comprises a plurality of means 10 for engaging a limb connected adjacent to one another.

Figure 2:
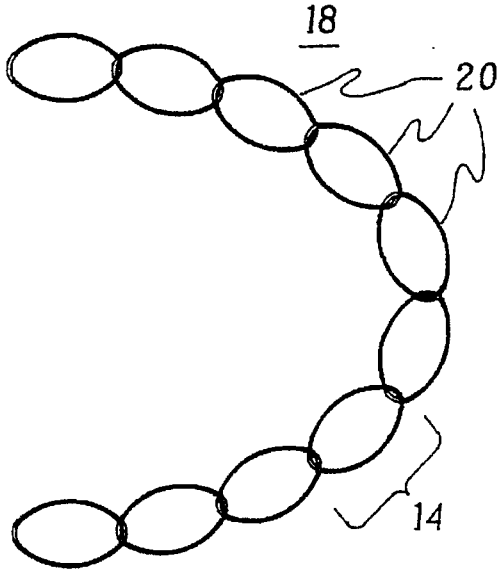
FIG. 2 is a top view of another embodiment of the apparatus of the subject invention wherein the engaging means comprises a loop.
Figure 3:
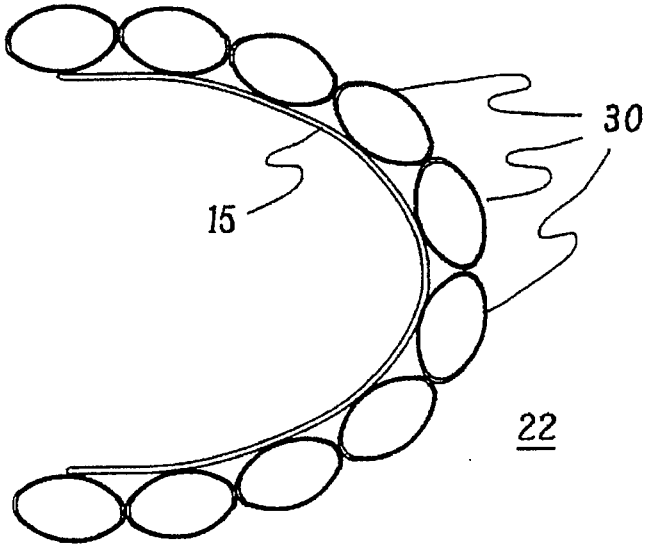
FIG. 3 is a top view of a further embodiment of the apparatus of the subject invention wherein the engaging means are attached to a cord.

The engaging means 10 are sized such that each engaging means could hold part of a human limb, such as a foot, knee, elbow or hand. The engaging means are preferably of equal size, however, the sizes may be varied for specific exercises and function. Any compartment, pocket or loop capable of holding or engaging the above limbs is meant to be encompassed within the term engaging means 10. A pocket 12 is shown in FIG. 1. In the embodiment of the apparatus 18 shown in FIG. 2, the engaging means 20 comprises a loop 14. As shown in FIG. 3, the apparatus 22 may be formed by simply attaching a plurality of engaging means 30 to a cord 15.

The invention may be made of various materials having the characteristics of being pliable yet substantially inelastic. An example of such a material is nylon. Alternatively, the material could be a net-like material.

The plurality of engaging means may be formed from a single piece of material. A piece of material that is substantially rectangular may be folded over such that one edge of the material comes in contact with the opposite edge. Then, at certain chosen points the two edges are permanently attached, thereby forming a series of engaging means between the points of attachment. The width of the enclosure may be determined by the distance between the points of attachment, and the depth may be determined by the width of the unfolded material. The points of attachment may be made by stitching, bartacking or bonding the two edges of the material together.

The apparatus may further be formed by individually connecting several engaging means, end to end, so that a line of engaging means are formed. The engaging means may be attached by stitching, bartacking or bonding the enclosures together. However, any means for connecting the material forming the engaging means commonly known in the art can be used.

Figure 4:
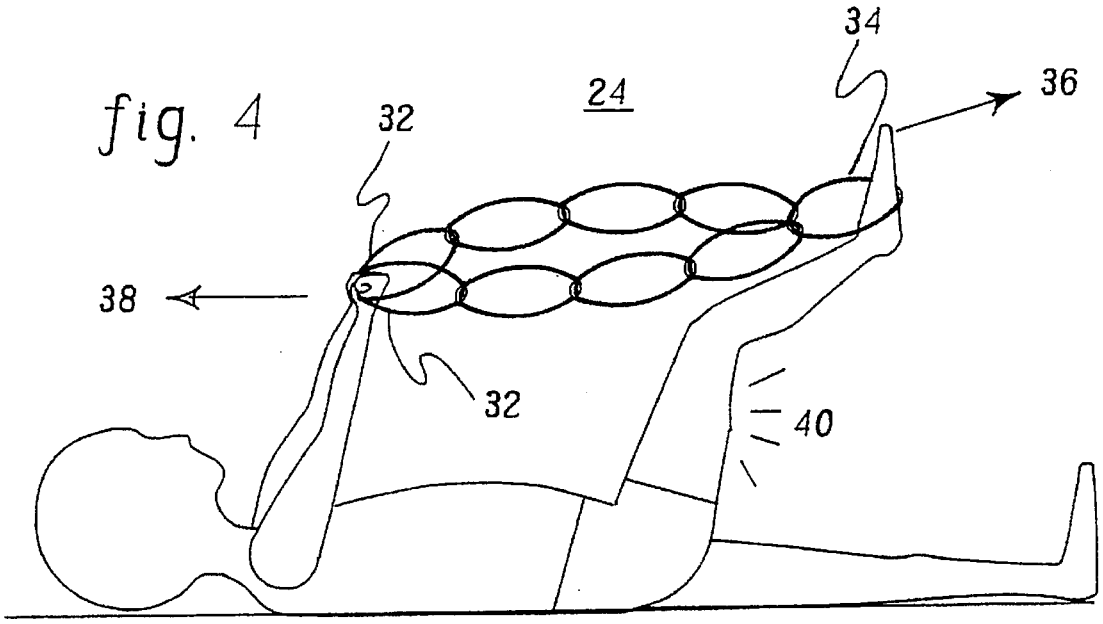
FIG. 4 is a perspective view illustrating use of an apparatus of the subject invention by pulling away from the direction of limb movement.

In its use, as shown in FIG. 4, one of the plurality of engaging means 34 of the apparatus 24 is used to engage a portion of a limb. Engaging means 32 on each side of the "engaged" engaging means are then grasped as the engaged limb is moved in a direction 36. The grasped engaging means are then pulled 38 opposite the direction of limb movement in order to enhance stretching of muscles 40 in the engaged limb.

Figure 5:
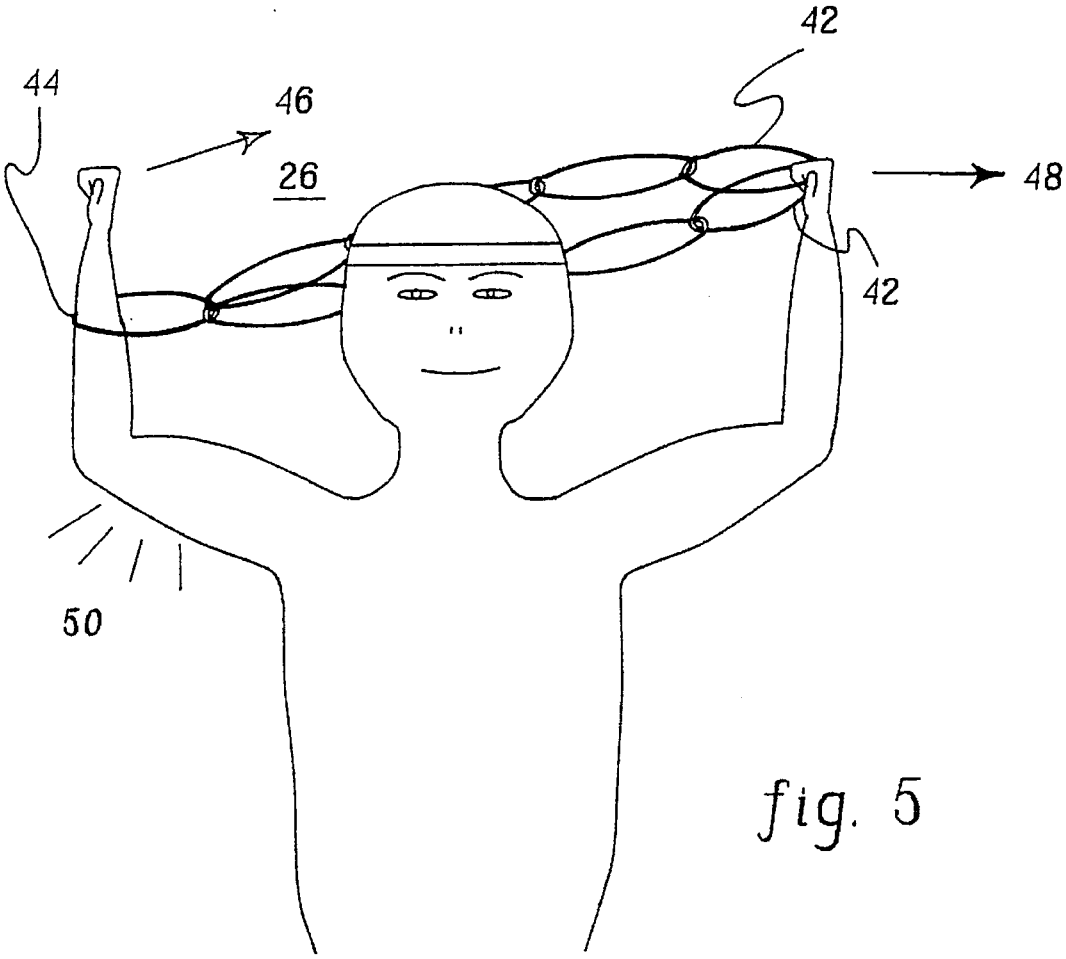
FIG. 5 is a perspective view illustrating use of an apparatus of the subject invention by pulling toward the direction of limb movement.

Alternatively, as shown in FIG. 5, it may be desirable to pull 48 the grasped engaging means 42 in a direction which is the same direction 46 in which the engaged limb is being moved. Again, however, the force applied to the engaging means 44 of the apparatus 26 enhances stretching of muscles 50 in the engaged limb by creating resistance which increases the benefits of the stretching. This allows the limbs to achieve a greater degree of flexion or extension than would have been possible without the added force applied via the apparatus of the present invention.

The present invention can be utilized with any methods of stretching commonly used or known today. Although preferred embodiments have been depicted and described in detail herein, it will be apparent to those skilled in the relevant art that various modifications, additions, substitutions and the like can be made without departing from the spirit of the invention and these are therefore considered to be within the scope of the invention as defined in the following claims.

What is claimed is:

1. A method of stretching muscles in a limb utilizing an elongated inelastic apparatus, said elongated inelastic apparatus comprising a plurality of pliable, inelastic means for engaging a limb, said engaging means being connected adjacent to one another, said method comprising the steps of:

engaging a portion of a limb with one of said plurality of pliable, inelastic engaging means;

grasping pliable, inelastic engaging means on each side of said one pliable, inelastic engaging means;

moving the engaged limb in a direction; and pulling the grasped pliable, inelastic engaging means in said direction, thereby enhancing stretching of muscles in said limb.

2. The method of claim 1 wherein said engaging means comprises a loop and said limb portion is engaged by encircling said limb portion with the loop.

3. The method of claim 1 wherein said engaging means comprises a pocket and said limb portion is engaged by inserting said limb portion within said pocket.

4. A method of stretching muscles in a limb utilizing an elongated inelastic apparatus, said elongated inelastic apparatus comprising a plurality of pliable, inelastic means for engaging a limb, said engaging means being connected adjacent to one another, said method comprising the steps of:

engaging a portion of a limb with one of said pliable, inelastic engaging means;

grasping pliable, inelastic engaging means on each side of said one pliable, inelastic engaging means;

moving the engaged limb in a first direction; and pulling the grasped pliable, inelastic engaging means in a second direction opposite said first direction, thereby enhancing stretching of muscles in said limb.

5. The method of claim 4 wherein said engaging means comprises a loop and said limb portion is engaged by encircling said limb portion with the loop.

6. The method of claim 4 wherein said engaging means comprises a pocket and said limb portion is engaged by inserting said limb portion within said pocket.

7. A method of stretching muscles in a limb utilizing a pliable, inelastic apparatus, said apparatus comprising a plurality of pliable, inelastic means for engaging a limb, connected adjacent to one another, said method comprising the steps of:

(a) engaging a portion of a limb with one of said pliable, inelastic engaging means;

(b) grasping pliable, inelastic engaging means on each side of said one engaging means;

(c) moving the engaged limb in a direction; and (d) pulling the grasped, pliable inelastic engaging means in said direction, thereby enhancing stretching of muscles in the limb.

8. The method of claim 7 wherein said engaging means comprises a pocket and said limb portion is engaged by inserting said limb portion within said pocket.

9. The method of claim 7 wherein said engaging means comprises a loop and said limb portion is engaged by encircling said limb portion with the loop.

10. A method of stretching muscles in a limb utilizing a pliable, inelastic apparatus, said apparatus comprising a plurality of pliable, inelastic means for engaging a limb connected adjacent to one another, said method comprising the steps of:

(a) engaging a portion of a limb with one of said pliable, inelastic engaging means;

(b) grasping pliable, inelastic engaging means on each side of said one engaging means;

(c) moving the engaged limb in a first direction; and (d) pulling the grasped, pliable inelastic engaging means in a second direction opposite the first direction, thereby enhancing stretching of muscles in the limb.

11. The method of claim 10 wherein said engaging means comprises a pocket and said limb portion is engaged by inserting said limb portion within said pocket.

12. The method of claim 10 wherein said engaging means comprises a loop and said limb portion is engaged by encircling said limb portion with the loop.

13. A method of stretching muscles, comprising the steps of:

(i) engaging a portion of a limb with one of a plurality of pliable, inelastic engaging means bendably connected to each other;

(ii) grasping pliable, inelastic engaging means on each side of the one pliable, inelastic engaging means;

(iii) moving the engaged limb in a first direction; and (iv) pulling the grasped pliable, inelastic engaging means in the first direction or in a direction opposite the first direction, thereby enhancing stretching of muscles in the limb.

14. The method of claim 13 wherein said engaging means comprises a pocket and said limb portion is engaged by inserting said limb portion within said pocket.

15. The method of claim 13 wherein said engaging means comprises a loop and said limb portion is engaged by encircling said limb portion with the loop.

* * * * *